United States Patent [19]

Waldner

[11] Patent Number: 4,840,277

[45] Date of Patent: Jun. 20, 1989

[54] PACKING DEVICE HAVING SUPPORT TAB

[75] Inventor: Charles Waldner, Georgetown, Mass.

[73] Assignee: United Foam Plastics Corporation, Georgetown, Mass.

[21] Appl. No.: 206,423

[22] Filed: Jun. 14, 1988

[51] Int. Cl.[4] ..... B65D 81/04

[52] U.S. Cl. ..... 206/523; 206/588; 206/591; 229/DIG. 1

[58] Field of Search ..... 206/521, 523, 586, 588, 206/591-594; 229/DIG. 1

[56] References Cited

U.S. PATENT DOCUMENTS

| | | | |
|---|---|---|---|
| 3,565,243 | 2/1971 | Freeman | 206/523 |
| 3,580,469 | 5/1971 | Reese | 206/521 |
| 3,695,421 | 10/1972 | Wood | 206/523 |
| 3,854,650 | 12/1974 | Hanoue | 206/521 |
| 3,994,433 | 11/1976 | Jenkins | 206/523 X |
| 4,122,946 | 10/1978 | Holley | 206/523 |
| 4,360,145 | 11/1982 | Wilcox | 206/594 X |

FOREIGN PATENT DOCUMENTS

| | | | |
|---|---|---|---|
| 2007542 | 9/1971 | Fed. Rep. of Germany | 206/523 |
| 1251212 | 10/1971 | United Kingdom | 206/523 |
| 2081678 | 2/1982 | United Kingdom | 206/523 |

*Primary Examiner*—Bryon P. Gehman
*Attorney, Agent, or Firm*—Lahive & Cockfield

[57] ABSTRACT

A plastic packing device, die cut from a block of foam plastic, has legs pivotable out of a central cavity, forming a collar connected by a living hinge to the legs. The legs have widened bottom portions that snap over the surface of the collar to help maintain the legs in a perpendicular position. A support tab, connected to each leg by a second living hinge colinear with the first, is pivotable to a position between the leg and the collar, to maintain the leg in the perpendicular position.

6 Claims, 4 Drawing Sheets

PACKING DEVICE HAVING SUPPORT TAB

BACKGROUND OF THE INVENTION

The invention relates to foam plastic shock-absorbing packing devices used in containers for protecting objects during shipment.

Fragile or breakable objects are frequently packed or packaged with special shock-absorbent material, such as polyethylene foam or other expanded plastics. These materials are generally light in weight and highly shock-absorbent, and consequently afford excellent protection against breakage or damage during shipment and handling.

Foam plastic packing devices of this type can be used to protect articles, equipment, or other objects of various sizes, weights and fragilities. Typically, the object is placed in a container and suitably cushioned, by interposing the shock-absorbent foam plastic materials or packing devices between the inner surface of the container and the object. Such packing materials and devices play an important role for transported items such as computers and electronic instruments that must arrive at their ultimate destination undamaged.

Often the foam plastic material that best serves the purpose of protection is in the form of a configuration, rather than simple blocks or chips. Efforts have been made to provide configured foam plastic devices inexpensively and conveniently. One approach is to cut a block of foam plastic material, so that elements of it are hinged. The hinged elements can then be folded out to form a configured device suitable for the item to be protected or for the container in which the protected item is to be shipped.

U.S. Pat. No. 3,854,650 shows such an approach, in which standing portions are hingedly pivoted from a flat portion, and locked into place. In another approach, depending legs of foam plastic material are pivoted down from a flat portion, leaving a central cavity and a collar of foam material. The collar is expandable by means of slits that form an expanded grid when the opposite ends of the collar are pulled apart.

SUMMARY OF THE INVENTION

Accordingly, an object of the invention is to provide a reusable packing device of rugged construction which is adaptable to protect items of various sizes.

It is another object of the invention to provide an improved packing device which is inexpensive in terms of materials, manufacture, shipping, and storage.

It is yet another object of the invention to provide a packing device which is convenient to assemble for use, and is of compact design for improved space utilization when not in use.

These and other objects of the invention are achieved by an improved packing device of unitary construction of resilient foam material. The packing device has an expandable collar and depending legs connected by a living hinge to the collar for pivotable movement from a storage position within the collar to an in-use position extending perpendicular to the collar. In the in-use position the depending legs are supported by support tabs which are positionable behind the legs to maintain them in position. More specifically, the support tabs are each associated with one of the depending legs and independently pivotable, when the associated leg is in its in-use position. When so pivoted, each support tab is disposed behind the associated leg and helps the leg from pivoting further from its perpendicular position.

This complements a feature in which the depending legs are contoured so that they are wider near their hinge. As the depending legs are pivoted to their in-use positions, these wider portions resiliently compress. After the depending legs are in their in-use position, the wider portions snap back to their non-deformed shape and project over the collar, thus preventing the legs from pivoting back to their storage position.

In the preferred embodiment of the packing device, the collar is adjustable to several different stable lengths by means of an expandable grid arrangement. More specifically, the collar has longitudinal elements, each with an expandable grid. The grid is formed by a network of overlapping transverse slits extending through the material thickness of the longitudinal element and ending intermediate its lateral extent in cylindrical holes. Extension of the length of the collar in the longitudinal direction is achieved by "popping" open the expandable grid, thus broadening the slits into channels, resulting in the lengthening of the longitudinal elements.

The invention will next be described in connection with an illustrative embodiment. However, it should be appreciated that various changes, modifications and additions can be made by those skilled in the art without departing from the scope of the invention as defined in the appended claims.

DETAILED DESCRIPTION

Figure 1:
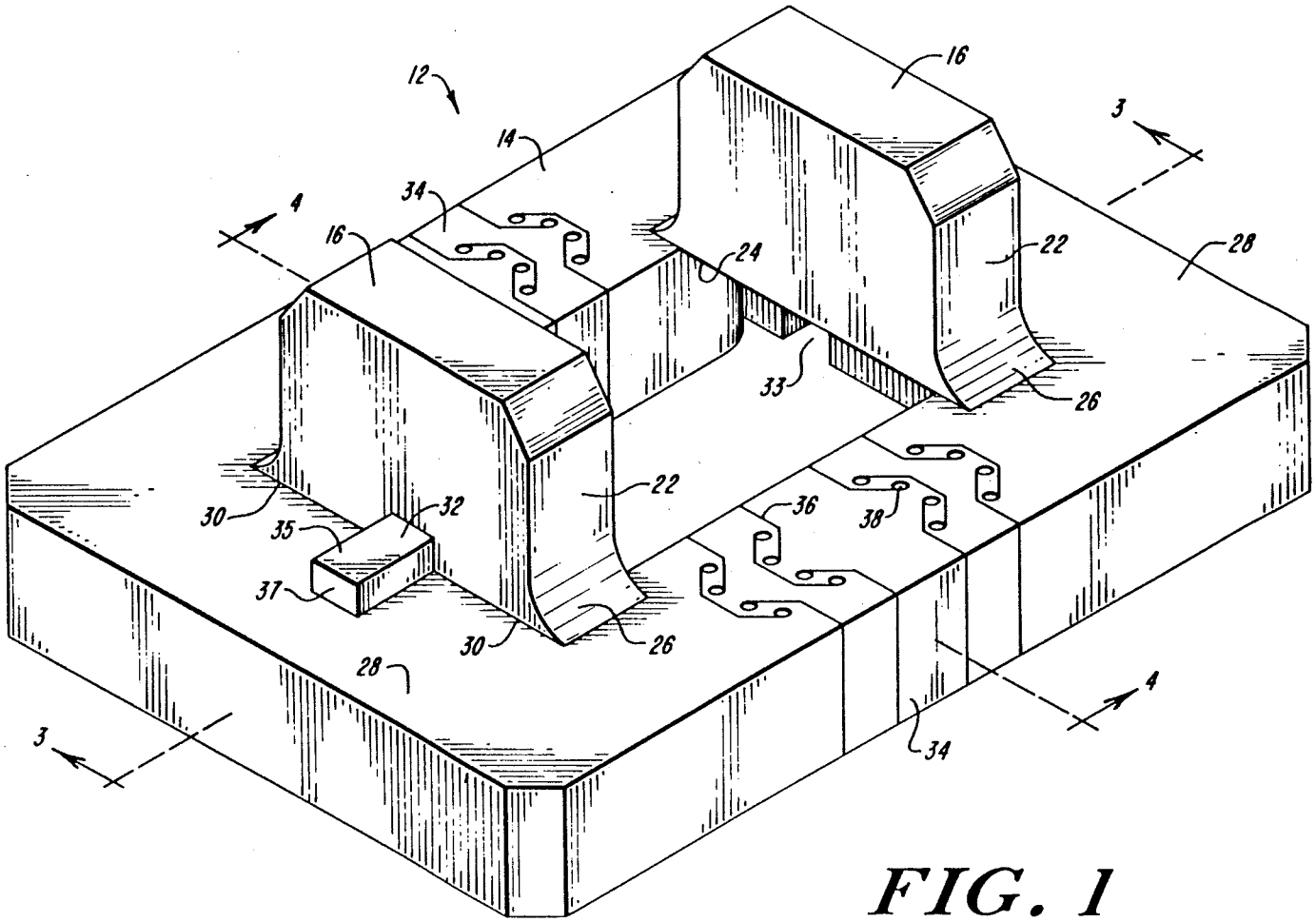
FIG. 1 is a perspective view of a cap embodying the invention, available for use.

FIG. 1 shows a packing cap 12 embodying the invention, in the opened position. In the opened position, the end cap 12 has a collar 14 with a pair of legs 16 extending perpendicularly to the plane of the collar 14.

Figure 2A:
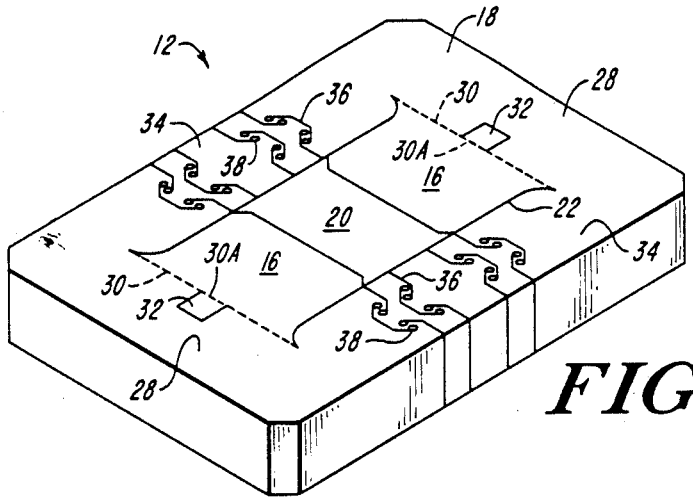
FIG. 2A is a perspective view of the cap in block form, just after manufacture.

The packing cap 12 is made from a single block 18 of foam plastic material, as shown in FIG. 2A.

As shown there, the packing device is molded as a block of foam for more efficient use of material and reduced material costs. Furthermore, the device 12 can be stored and transported in the closed position, after a center plug 20 is removed (see FIG. 2B) and discarded, until it is used as packing to support a surface of an object to be protected.

As seen in FIG. 2A, a central plug 20 is die cut from the generally rectangular block 18 of foam plastic. The sides 22 of legs 16 are also die cut, the sides 22 flaring outwardly toward the base 24 of the leg 16, to form arcuate lower leg portions 26. The bases 24 of the legs 16 are not cut from the lateral portions 28 of the collar 14. Rather, a "living hinge" 30 is formed at the base 24 of the leg 16. That is, the foam making up the hinge 30 is thinned and densified for strength, as by compressing the foam material during fabrication of the hinge, by a dull blade.

Furthermore, each leg 16 has at its base 24 an associated support tab 32. The support tab is a smaller rectangular block die cut out of the lateral collar portion 28 on three sides, but joined to the leg 16 by a colinear portion of the living hinge 30. Thus, originally the collar 14, the legs 16 and the support tabs 32 are in a coplanar relationship.

Finally, in the longitudinal portions 34 of the collar 14, a network of overlapping transverse slits 36 extending through the block of material is die cut. Cylindrical plugs 38 die cut through the block at the termination of the slits 36 form holes 40 at the end of the slits 36 when they are removed like the center plug 20.

Figure 2B:
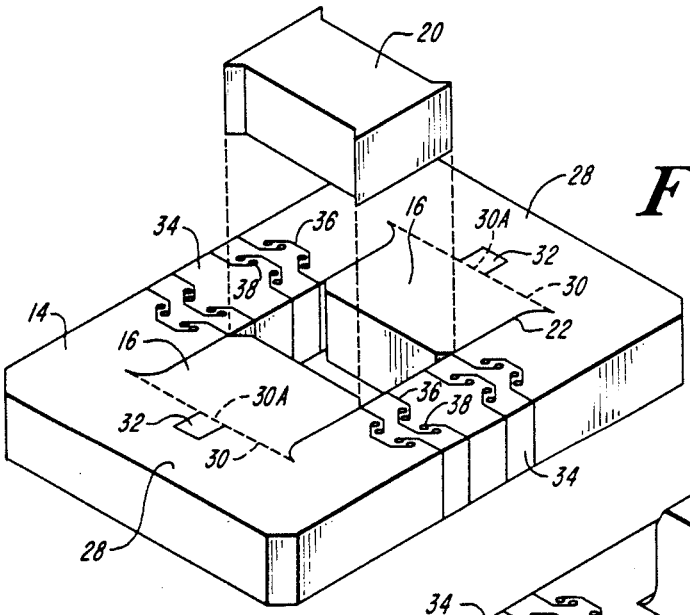
FIG. 2B is a view like that of FIG. 2A, showing the center plug of the block lifted out.

FIG. 2B shows the removal of the center plug 20, which has no role to play in the use of the cap 12. The cylindrical plugs 38 may also be discarded at this time.

Figure 2C:
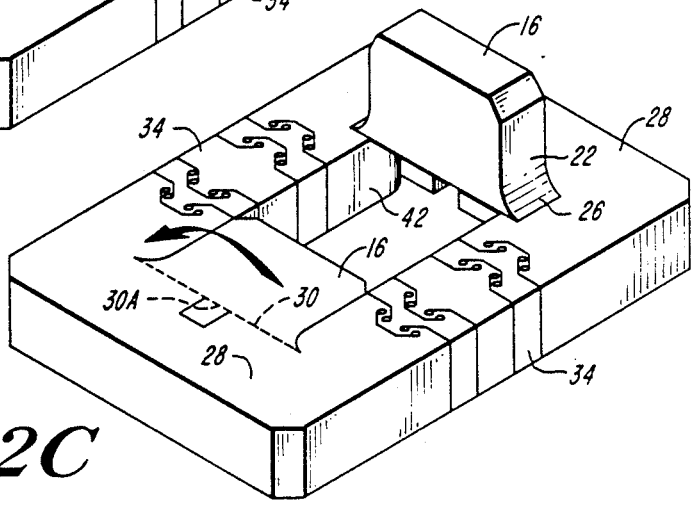
FIG. 2C is a view like that of FIG. 2B, with one of the legs pivoted 90°.

FIG. 2C shows one leg 16 pivoted into position and an arrow showing the direction in which the other leg will be pivoted. As a leg 16 is pivoted about the hinge 30 at its base 24, the arcuate lower portions 26 are compressed as they pass by the inner walls 42 of the center cavity 44.

Figure 4:
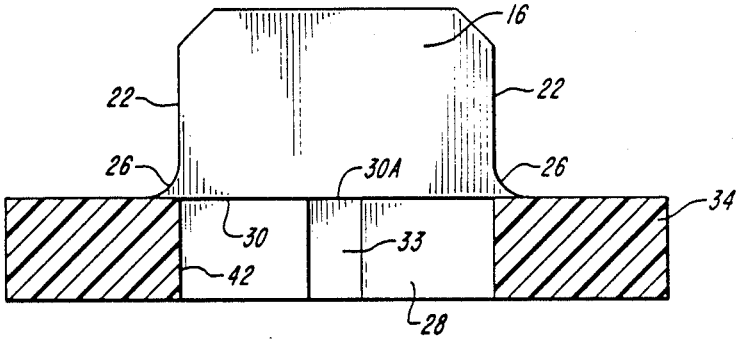
FIG. 4 is a sectional view of the cap, along the line 4—4 of FIG. 1.

When the legs 16 are pivoted 90°, the arcuate lower portions 26 snap free of the walls 42, and extend over the top of the collar 14, locking the legs 16 in place in a position perpendicular to the collar 14 (see FIG. 4).

At the same time, the support tab 32 also generally pivots with the leg 16, although it is separated from the leg base 24 for most of its length, and is connected to it only by a portion 30A of the living hinge.

The support tab 32 is then put into a position behind the leg 16 where it prevents the leg 16 from pivoting further away from the center cavity 44. The tab 32 is pivoted back to its original position in the block 18 and then still further, compressing to squeeze through the cavity 33 in the block 18 that was created by cutting out the support tab 32.

Figure 3A:
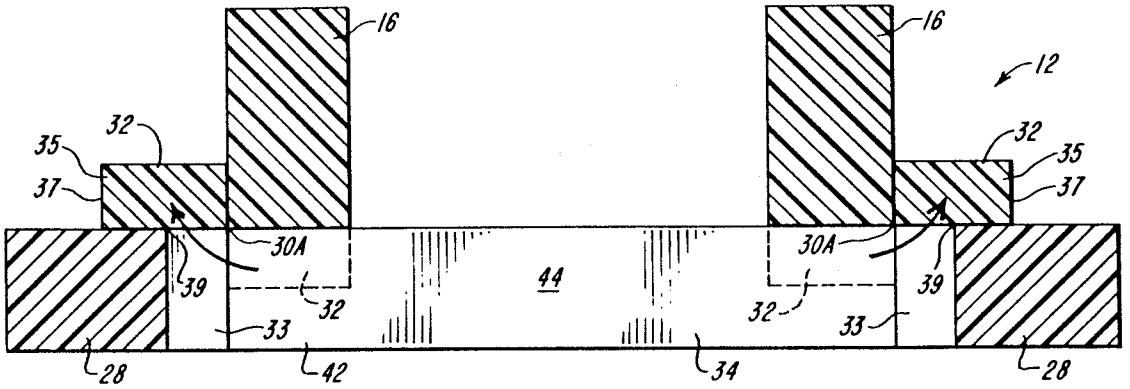
FIG. 3A is a sectional view of the cap, along the line 3—3 of FIG. 1, showing one position of the locking support tab.

The support tab 32 can take two positions. As shown in FIG. 3A, the tab 32 is pivoted backward from its original position shown in dotted lines until its lower portion 35 escapes the cavity 33 and projects over the upper surface of the lateral collar portion 28. In that position the support tab 32 prevents pivoting movement of leg 16 away from the center cavity 44. The leg 16 is of course prevented from pivoting movement toward the cavity 44 by the position of the arcuate bottom portions 26 extended over the top of the collar 14. In effect, the leg 16 is prevented from pivoting in *either* direction, securely locked in place.

Figure 3B:
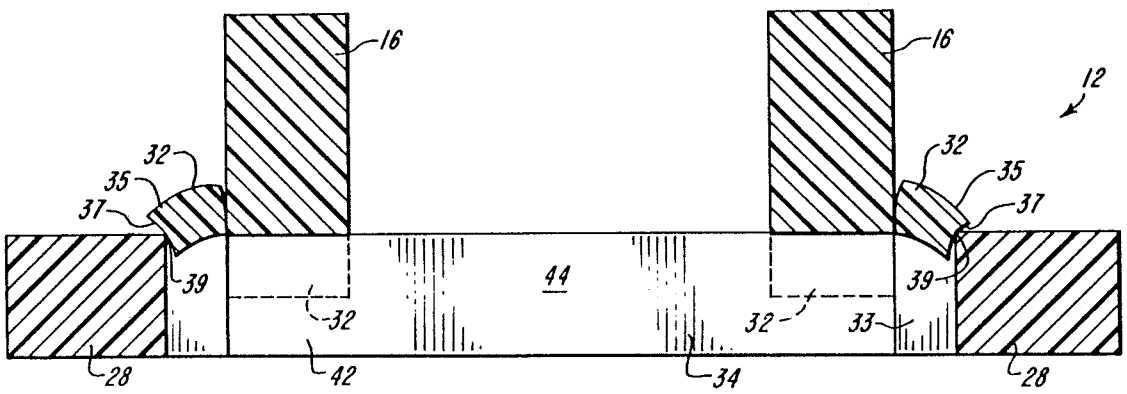
FIG. 3B is a sectional view like 3A showing another final position for the support tab.

The support tab 32 can take another position. As shown in FIG. 3B, the tab 32 may be pivoted backward until the bottom surface 37 of the tab lower portion 35 presses against the upper edge 39 of the cavity 33. Left in that position, the support tab 32 is firmly wedged in place, enhancing the force with which the leg 16 is prevented from pivoting backward.

Figure 5:
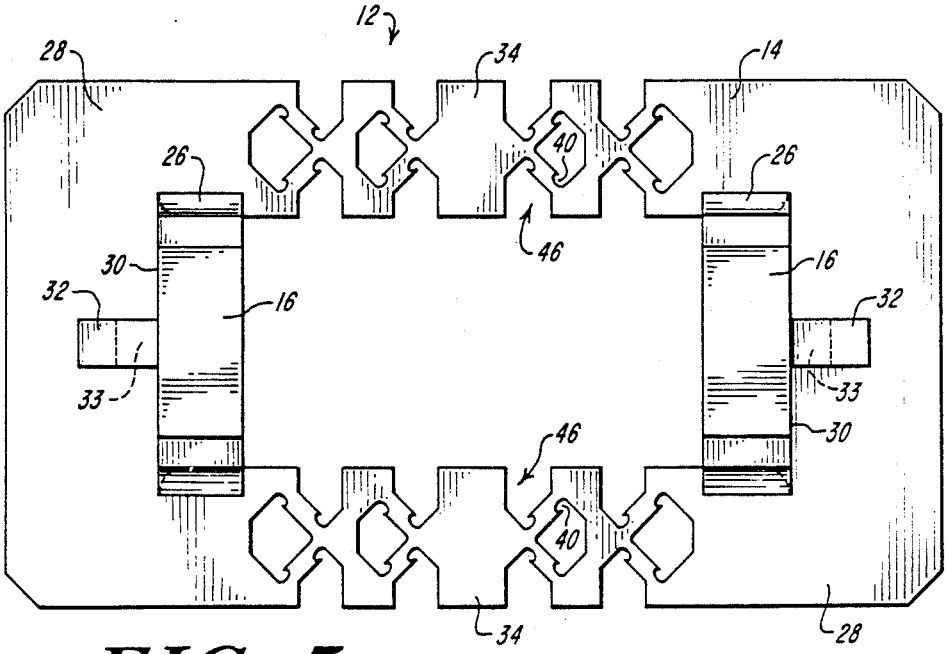
FIG. 5 is a plan view of a cap, in expanded form.

As shown in FIG. 5, collar 14 is adjustable to different discrete lengths. The longitudinal portion 34 of the collar 14 may be stretched so that the slits 36 create an expandable grid 46, in which the slits 36 become channels. The effect is one of "popping" open the grid 46, with one or more sections of the grid popping open as needed, so that there are several relatively stable lengths of the collar 14 possible.

The packing device 12 is used to cushion a rectangular object having one dimension equal to the distance between the expandable sides of collar 14 and another greater than or equal to the distance between the opposed inner surfaces of legs 16. In use, the flat device illustrated in FIG. 2A is opened to form the configuration of FIGS. 1, 3A, or 3B, expanded if necessary as shown in FIG. 5, and placed about a surface of the object to be cushioned. Arcuate lower portions 26 of legs 16 cooperate with tabs 32 to orient properly the legs 16 and to maintain their engagement with the side of a carton. The other end of the object is similarly protected, and the object is placed in a box of suitable dimensions. If desired, center plug 20 may be disposed within the box to cushion its ends.

What is claimed is:

1. A foldable plastic packing device, comprising:
   - a collar, having longitudinal elements and lateral elements, that frames a central cavity,
   - at least one leg element hingedly connected to a lateral element and pivotable into said central cavity, said leg element having widened portions to project over said collar and maintain said leg element in a position perpendicular to said collar,
   - a support tab, hingedly connected to said leg element, positionable between said leg element and said lateral element to assist in maintaining said leg element in a position perpendicular to said collar.

2. The device of claim 1 in which said longitudinal elements are expandable.

3. The device of claim 1 in which said leg element is hingedly connected to said lateral element by a first living hinge and said support tab is hingedly connected to said leg element by a second living hinge.

4. The device of claim 3 wherein said first living hinge and said second living hinge are colinear.

5. The device of claim 1 wherein said collar, said leg, and said support tab are pivotable into a co-planar relationship.

6. A plastic packing device comprising a block of plastic, die-cut to form:
   - a collar having outer longitudinal elements and outer lateral elements that surround an interior portion,
   - a leg element in said interior portion, hingedly connected by a first living hinge to one of said outer lateral elements, and pivotable out of said interior portion to a position perpendicular to said collar, said leg element having widened
   - portions adjacent said living hinge to project over said collar and maintain said leg element in said position perpendicular to said collar,
   - a support tab, hingedly connected to said leg element by a second living hinge colinear with said first living hinge, and pivotable oppositely from said leg element out of said interior portion, to a position between said leg element and said one lateral element to assist in maintaining said leg element in said perpendicular position.

* * * * *